US006152028A

United States Patent [19]

Skyllermark

[11] Patent Number: 6,152,028

[45] **Date of Patent: *Nov. 28, 2000**

[54] MACHINE FOR PRESS WORK

[76] Inventor: Stefan Skyllermark, Terrassvägen 14, S-131 41 Nacka, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/973,972

[22] PCT Filed: Jun. 14, 1996

[86] PCT No.: PCT/SE96/00777

§ 371 Date: Mar. 31, 1998

§ 102(e) Date: Mar. 31, 1998

[87] PCT Pub. No.: WO97/00158

PCT Pub. Date: Jan. 3, 1997

[30] Foreign Application Priority Data

Jun. 16, 1995 [SE] Sweden ..... 9502207

[51] Int. Cl.[7] ..... B30B 15/04

[52] U.S. Cl. ..... 100/214; 144/286.1

[58] Field of Search ..... 100/53, 103, 214, 100/226, 269.01, 299; 144/286.1, 286.5

[56] References Cited

U.S. PATENT DOCUMENTS

| | | | |
|---|---|---|---|
| 2,692,407 | 10/1954 | Stacy | 100/226 |
| 2,699,108 | 1/1955 | Adams | 100/214 |
| 2,822,045 | 2/1958 | Moore | 100/226 |
| 3,211,085 | 10/1965 | Zeppetello | 100/214 |
| 3,315,595 | 4/1967 | Moehlenpah et al. | 100/214 |
| 3,690,206 | 9/1972 | Pickles | 100/53 |
| 4,063,453 | 12/1977 | Gram | 100/214 |
| 4,612,863 | 9/1986 | Vonhausen et al. | 144/286.1 |
| 5,765,273 | 6/1998 | Mora et al. | 144/286.1 |

FOREIGN PATENT DOCUMENTS

| | | |
|---|---|---|
| 424053 | 6/1982 | Sweden . |
| 1324341 | 7/1973 | United Kingdom . |
| 83/01591 | 5/1983 | WIPO . |

*Primary Examiner*—Stephen F. Gerrity
*Attorney, Agent, or Firm*—Finnegan, Henderson, Farabow, Garrett, Dunner, L.L.P.

[57] ABSTRACT

Machine for press work, or for example work in a drilling machine with a press (1) which can easily be raised, lowered and tilted in relation to its body (2). The work lights (4) follow the movement of the press up and down. The shelves (5) for material which is to be processed in the press also follows the press (1) when it is raised and lowered. The same is valid for the manoeuvre boxes (6). Thus you can handle the machine both in sitting and standing position, and very easily change between various working postures. The press table (3) is thin and hangs in the press (1) which hangs in the body (2) so that the operator can sit at the press table (3) and work in the same posture as at a desk. The top part of the press tool is fixed in the tool holder (7), the lower part of the press tool is fixed in the press table (3).

6 Claims, 2 Drawing Sheets

MACHINE FOR PRESS WORK

BACKGROUND OF THE INVENTION

This invention relates to a machine, principally but not exclusively, designed for press work. The press may, for example, be a drilling machine and the work carried out drilling work.

The reason for the invention is because of all the industrial injuries resulting from fatigue caused by working with press machines. Previously alot of effort has been put into preventing injuries caused by a malfunction of the press. For example, a double stroke by eccentric presses. A double stroke can easily lead to the operator having his fingers cut off, etc.

The effort to improve the safety of the presses has been successful. Nevertheless very little has been done to solve the larger problem of injuries to the operator caused by fatigue by working with the press. Presses are, generally speaking, poor work places seen from an ergonomic point of view. Monotonous and inconvenient working postures and deficient illumination is the rule. It is well known that deficient work illumination causes injuries. The absence of load-relieving shelves for workpieces on the presses is standard as well. The press designers have consequently concentrated on designing presses that are fast, have high press power and are equipped with large worktables for large tools, etc. Automated methods of working have also been developed.

However, there is still a large part of the press work that cannot be automated or exchanged for other methods. Consequently there will in the future still be a large number of injuries caused by the worker being worn out from using the press. The present invention is designed to decrease these number of injuries.

Previously known presses are available on which the press table is adjustable relative to the part supplying the press power. Other presses have an adjustable part supplying the press power. Yet other presses that can be tilted backwards are available. There are also presses on which one can fit one's legs under the press table.

The press types mentioned above all have poor ergonomics. The legs do not fit under the press table well enough to offer a convenient working posture. Also, one cannot alternate sitting and standing positions at the press to prevent monotonous strain. Further, the presses cannot be easily tilted backwards to get a good view of the workpieces and press tools. Moreover the work lights are constantly poor. The presses do not come with proper illumination, or places to fit such.

Deficient illumination is often the cause of neck and shoulder problems. Inconvenient working posture at the press causes even more physical problems. Monotonous working postures are harmful as well. Another cause of pain and aches is when the operator continually has to raise his arms and hands upwards. In order to reduce these inconveniences, balance blocks are used to lift the arms. Yet these cause injuries from strain. Consequently the press has to be more adapted to the human anatomy in order to create a more convenient working posture.

SUMMARY OF THE INVENTION

The present invention solves these problems by providing a press with a press part 1 which easily can be raised, lowered and titled in relation to its body 2. Its work lights 4 follow the movement of the press part up and down and its shelves 5, for the work pieces that are to be processed in the press, also follow the press part I when it is raised or lowered. The same is true for the manoeuver boxes 6. The press table 3 is thin and hangs from the press part 1 which hangs from the body 2 so that the operator can sit at the press table 3 and work in the same posture as at a desk. The top part of the press tool is fixed in the tool holder 7 and the lower part of the press tool is fixed in the press table 3.

BRIEF DESCRIPTION OF THE DRAWINGS

In the following the invention will be described in more detail with reference to the enclosed drawings.

DETAILED DESCRIPTION OF THE INVENTION

Figure 1:
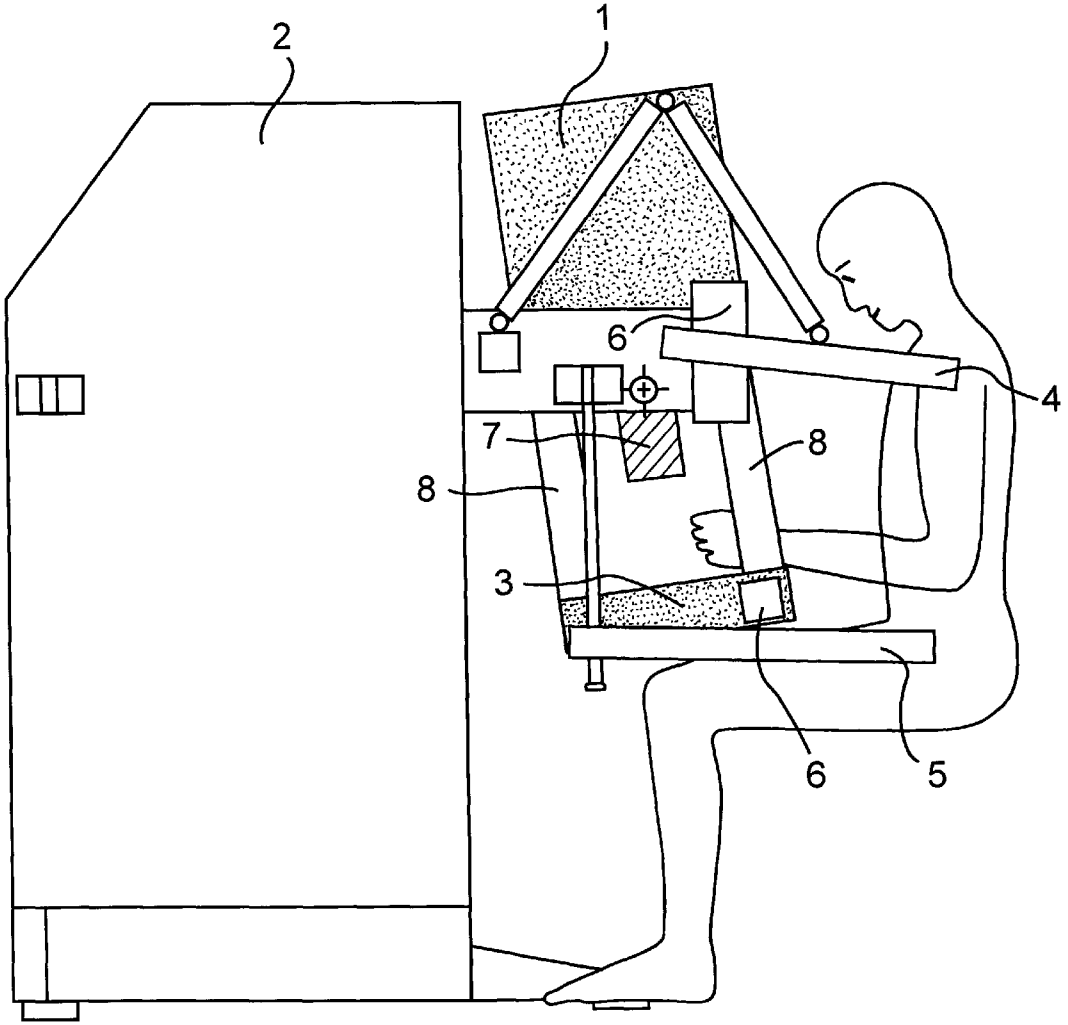
FIG. 1 is a side view with the operator in sitting position.
Figure 2:
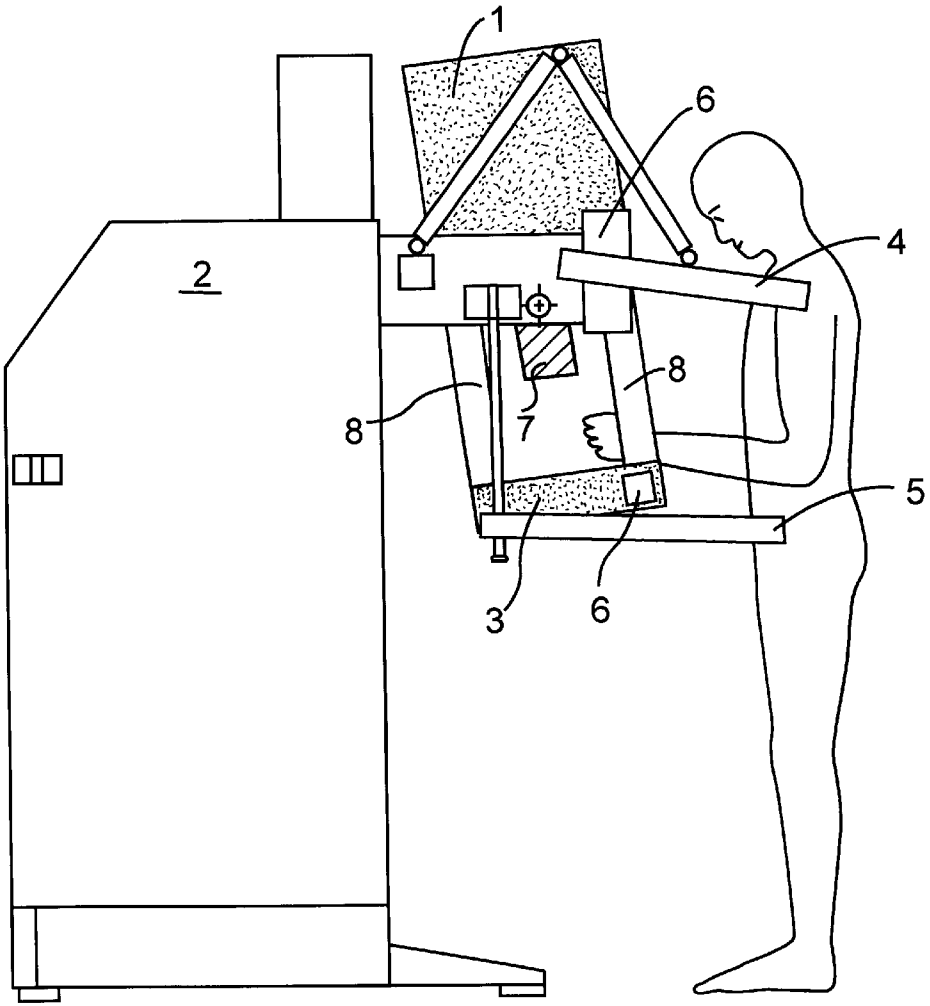
FIG. 2 is a side view with the operator in standing position.

In the drawings, 1 represents the press part, which is supported by a body 2. The press table 3 hangs from the press part 1 by pillars 8. The work lights 4, the shelves 5 and the manoeuver boxes 6 are also fixed to the press part 1. The top part of the press tool is fixed in the tool holder 7.

The press part 1 which supplies the press power is separated from the body. The press part contains the press table and the part supplying the press power. Thus the press part can be raised, lowered and tilted in relation to the floor on which the operator is standing or sifting.

It is essential to be able to easily adjust one's working level. It is important to have the option of whether to sit or to stand and to be able to tilt the press part. It is not only the operator of the press who has to be able to adjust the height and angle of the press part, but also the person who mounts the tool into the press and gets the tool working. The maneuvering must be swift and quick enough so that the operator will have the time to adjust the press properly. Certain models of the press are therefore equipped with a memory, so that the operator with just a push of a button or by turning a personal key or something similar, can adjust the press to exactly the same position defined at an earlier occasion. Thus a physiotherapist can be consulted to help find a perfect personal working posture.

The press part must have a thin press table 3. Otherwise one has to lift one's arms too high, with fatigue injuries as a result. Having to lean too far into the press or after the workpieces is likewise harmful. A working posture similar to when working at a desk is desirable. The work lights 4 must be adjustable as is common with the lights of a desk, to prevent reflections and to make sure that the workpieces and tools are properly illuminated.

The maneuvering is handled by the manoeuver boxes, which follow the press part when it is adjusted in height. Optimal working posture can therefore be achieved without the slightest effort. Shelves, work lights and maneuver boxes follow the press table, when the press part is adjusted in height. Accordingly, in order to change from a sitting to standing position, all it takes is the push of a button. The press part will then be raised to the new position and the press table, the shelves, the work lights and the manoeuver boxes will follow.

The press part is equipped on each side with adjustable shelves 5 for the workpieces and adjustable work lights. Additional lighting is mounted so that both workpieces and tools are properly illuminated. Due to the adjustability of the shelves, the workpieces can be placed conveniently on the press table. The shelves can be removed and hung out of the way on the back of the press, if the workpieces, for example, are so big that they are put on pallets. The pallet lifter, preferably an adjustable model, can then be positioned close to the press table. The pallet lifter must be close to the press table so that the operator does not have to reach too far.

The press part is designed so that the operator can sit closely to the press table. Therefore there is space underneath the press table, as under a desk. There are no supporting legs that interfere. Moreover the table is thin to get a working posture similar to that at a desk. This is at variance with the fact that a press is designed to be rigid. The change in dimension in the body during pressing must be kept as small as possible to prevent the press tools from getting worn and to keep the tolerances of the workpieces.

The drawings show a press having four pillars 8 which work best with a thin press table. A two pillar press does not create any major problem, while a C-press becomes considerably more difficult to get to work properly when it is required that both workpieces and operator be close to the press table. A C-press interferes with the space under the press table. FIG. 1 shows that this is not at all the case when the four pillar press is used. The press is designed to be compact, so that a lot of space is not taken up by the press, but instead the operator and the workpieces can have a lot of room.

Of course, the machine does not have to be a press. The machine could, for example, be a drilling machine. Manual vertical drilling machines are seldom equipped with automatic feeding. Therefore one has to raise one's arm high to pull down the lever for each drilling. This feeding movement is inconvenient for the operator. On the other hand there are automatic drilling machines that may very well be mounted to a table.

This drilling unit with table can then be mounted to the body and thereby obtain all the advantages mentioned above.

Preferably, the press is a hydraulic four pillar press designed for use with high hydraulic pressure; a minimum of 600 bar. In this case the hydraulic cylinder can be very small and is fixed to the top part of the press part. The voluminous hydraulic pump with its electric motor is on the other hand mounted to the body of the press. Pump, valves, and cylinder are connected through hydraulic tubes and electrical cables running in flexible channels. These flexible channels are encased to prevent oil from squirting out, if a tube should break.

The possibility to tilt the press is not only beneficial to the operator, but it is often desired that a workpiece or scrap pieces be permitted to fall out of the press tool by gravity. This is possible by tilting the press part past 90 degrees.

By dividing the press into two main parts, press part 1 and body 2, the ergonomic advantages mentioned above are obtained. The press part contains the cylinder which supplies the press power and the return springs which supplies the return power. The press table hangs from the press part and offers the resistance. As noted, the shelves, work lights, and manoeuver boxes are mounted on the press part. On the other hand, the body can contain the hydraulic pump, the electric motor, the electric controls, the oil tank, the valves and the counterweight. The body, in its bottom, is equipped with a counterweight plate, onto which the motor is bolted with rubber suspension. By mounting the motor onto the heavy counterweight, sounds and vibrations are prevented. Covers and girders are mounted on top of the counterweight, so that a secure motor room is obtained. Cooling of the motor can be provided by the covers, the counterweight and oil circulation with the oil tank placed outside of the motor room, in order to obtain proper cooling.

In this way another ergonomic advantage is obtained, namely low sound level. Vibrations are also harmful to the human being, so the movable press part can be hung with a vibration reducing element between itself and the body. Vibrations through the hydraulic tube can be prevented by strategical placing of them. In this way both sound and vibrations are reduced.

What is claimed is:

1. A press machine comprising a press and a body for supporting the press, wherein the press can be raised and lowered and includes a power applicator and a thin press table which provides resistance during operation of the press, a tool holder, a press tool having a top part and a lower part, the top part of the press tool mounted in the tool holder, and the lower part of the press tool mounted in the press table, and work lights that move with the press when it is raised or lowered;

means for tilting the press in relation to the floor on which an operator is standing or sitting and providing vertical adjustment sufficiently for the operator to either sit or stand when operating the press.

2. A press machine according to claim 1, including shelves for holding work pieces, the shelves moving with the press when it is raised and lowered.

3. A press machine according to claim 1, including manoeuvre boxes that move with the press when it is raised or lowered.

4. A machine for press work comprising a press and a body for supporting the press, wherein the press can be raised and lowered and includes a power applicator and a press table which provides resistance during operation of the press, a tool holder, a press tool having a top part and a lower part, the top part of the press tool mounted in the tool holder, and the lower part of the press tool mounted in the press table, and shelves for holding work pieces, the shelves moving with the press when it is raised or lowered;

means for tilting the press in relation to the floor on which an operator is standing or sitting and providing vertical adjustment sufficiently for the operator to either sit or stand when operating the press.

5. Machine according to claim 4, including work lights that move with the press when it is raised or lowered.

6. Machine according to claim 4, including manoeuvre boxes that move with the press when it is raised or lowered.

* * * * *